US007011307B2

(12) United States Patent
Obama et al.

(10) Patent No.: US 7,011,307 B2
(45) Date of Patent: Mar. 14, 2006

(54) PAPER SHEET DETECTION APPARATUS

(75) Inventors: Masao Obama, Yokosuka (JP); Masashi Suzuki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 60 days.

(21) Appl. No.: 10/665,575

(22) Filed: Sep. 22, 2003

(65) Prior Publication Data

US 2004/0075213 A1 Apr. 22, 2004

(30) Foreign Application Priority Data

Oct. 18, 2002 (JP) ..... 2002-304619

(51) Int. Cl.
*B65H 7/02* (2006.01)

(52) U.S. Cl. ..... 271/258.01; 271/265.01; 271/264; 271/272

(58) Field of Classification Search ..... 271/260, 271/258.01, 259, 265.01, 265.02, 264, 272
See application file for complete search history.

(56) References Cited

U.S. PATENT DOCUMENTS

| | | | | |
|---|---|---|---|---|
| 2,992,822 | A * | 7/1961 | Fraidenburgh | 271/260 |
| 3,133,481 | A * | 5/1964 | McCormick et al. | 493/9 |
| 3,136,539 | A * | 6/1964 | Brooks | 271/97 |
| 3,168,307 | A * | 2/1965 | Munchbach et al. | 271/97 |
| 3,360,262 | A * | 12/1967 | Kekopoulos et al. | 271/227 |
| 3,774,192 | A * | 11/1973 | Boulter | 307/116 |
| 4,608,856 | A * | 9/1986 | Daly, Jr. | 73/37.7 |
| 4,643,415 | A * | 2/1987 | Kuehnert | 271/268 |
| 5,344,521 | A * | 9/1994 | Ohsaki | 156/584 |
| 5,634,636 | A * | 6/1997 | Jackson et al. | 271/225 |
| 6,442,369 | B1 | 8/2002 | Swartz et al. | 399/388 |
| 2001/0006276 | A1 | 7/2001 | Kerpe et al. | 271/309 |

FOREIGN PATENT DOCUMENTS

| | | |
|---|---|---|
| GB | 921362 | 4/1959 |
| JP | 2001-233501 | 8/2001 |

* cited by examiner

*Primary Examiner*—Donald Walsh
*Assistant Examiner*—Thomas Morrison
(74) *Attorney, Agent, or Firm*—Pillsbury Winthrop Shaw Pittman, LLP

(57) ABSTRACT

A paper sheet detection apparatus comprising a conveying belt which conveys a paper sheet along a conveying surface, a detection sensor which is provided opposite to the conveying surface and detects a paper sheet conveyed by the conveying belt, a sensor guide which is provided in at least the paper sheet take-in side of the detection sensor and formed with upper and lower guide members disposed opposite to each other at both side of the conveying surface, a nozzle which is provided in the opposite surface of the upper and lower guide members, and a gas supply device which supplies compressed gas to the upper and lower guide members and ejects the gas from the nozzle between the pair of guide members.

5 Claims, 8 Drawing Sheets

PAPER SHEET DETECTION APPARATUS

CROSS-REFERENCE TO RELATED APPLICATIONS

This application is based upon and claims the benefit of priority from the prior Japanese Patent Application No. 2002-304619, filed Oct. 18, 2002, the entire contents of which are incorporated herein by reference.

BACKGROUND OF THE INVENTION

1. Field of the Invention

The present invention relates to a paper sheet detection apparatus which detects the magnetic ink printed on paper sheets such as securities.

2. Description of the Related Art

One type of paper sheet detection apparatus detects a paper sheet by holding and conveying it to a detection sensor by a conveying belt, for example, or by holding and conveying a paper sheet to a detection sensor by a pair of conveying rollers.

Another type of paper sheet detection apparatus detects a paper sheet by placing a paper sheet on a conveying belt with holes and conveying it to a suction chamber. A paper sheet conveyed to a suction chamber is sucked onto a conveying belt by sucking out air through the holes in the conveying belt, and the whole non-sucked side of the sucked paper sheet is detected.

However, in the prior art, a paper sheet flaps or bends due to the vibration of a conveying belt or the fluctuation in the speed of a pair of conveying rollers, and such flapping and bending are mixed into the detection signal of a detection sensor as a noise, degrading the detection accuracy.

The present invention has been made taking notice of the above-mentioned circumstances. It is an object of the present invention to provide a paper sheet detection apparatus, which prevents flapping and bending of a paper sheet and obtain an accurate detection signal of a detection device.

BRIEF SUMMARY OF THE INVENTION

According to a first aspect of the present invention, there is provided a paper sheet detection apparatus comprising a conveying device which conveys a paper sheet along a conveying surface; a detection device which is provided opposite to the conveying surface and detects a paper sheet conveyed by the conveying device; a guide device which is provided in at least the paper sheet take-in side of the detection device and formed with a pair of guide members disposed opposite to each other at both sides of the conveying surface; a nozzle which is provided in the opposite surface of the pair of guide members; and a gas supply device which supplies compressed gas to the pair of guide members and ejects the gas from the nozzle between the pair of guide members.

According to a second embodiment of the present invention, there is provided a paper sheet detection apparatus comprising a conveying device which conveys a paper sheet along a conveying surface; a detection device which is provided opposite to the conveying surface and detects a paper sheet conveyed by the conveying device; a guide device which is provided in at least the paper sheet take-in side of the detection device and formed with a pair of guide members disposed opposite to each other at both side of the conveying surface; a nozzle which is provided in the opposite surface of the pair of guide members; an energizing device which elastically energizes one of the pair of guide members toward the other guide member; and a gas supply device which generates a clearance between the pair of guide members by moving one of the pair of guide members against the energizing force of the energizing device, by supplying compressed gas to the pair of guide members and ejecting the gas from the nozzle between the pair of guide members.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

The present invention will be explained in detail hereinafter with reference to the embodiments shown in the attached drawings.

Figure 1:
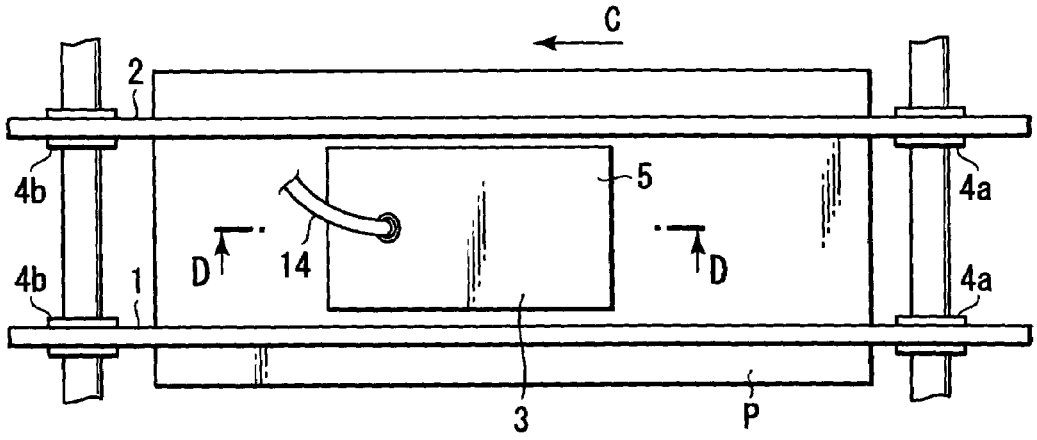
FIG. 1 is a top plan view of a paper detection apparatus according to a first embodiment of the present invention.
Figure 2:
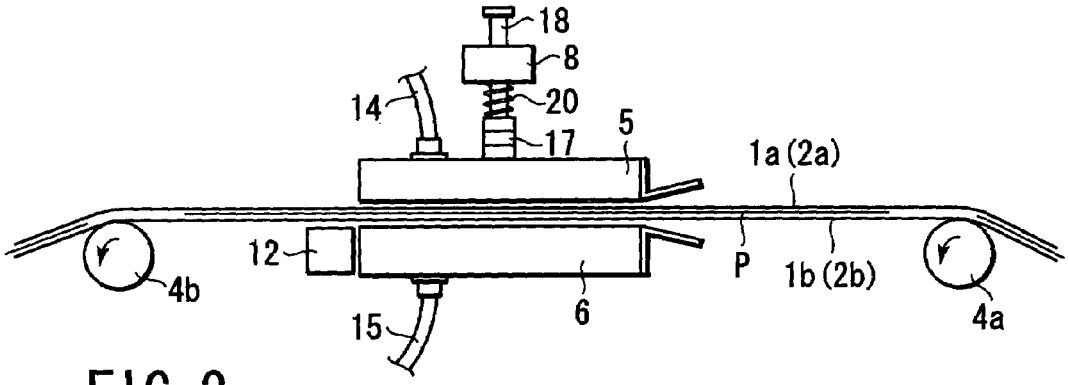
FIG. 2 is a front view showing the paper sheet detection apparatus of FIG. 1.
Figure 3:
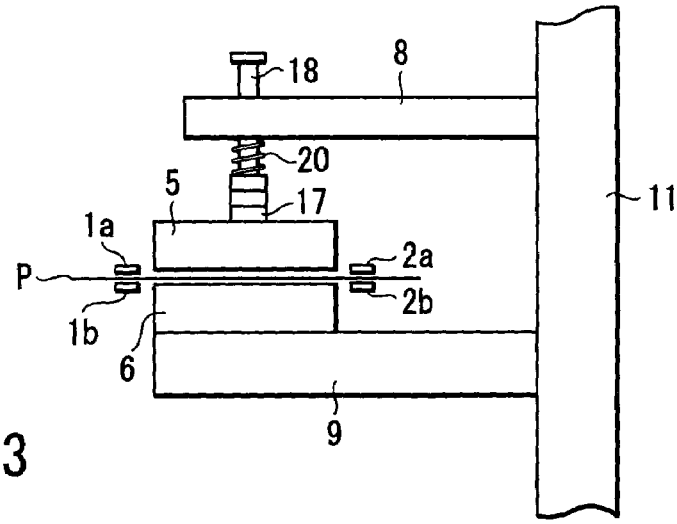
FIG. 3 is a side view showing the paper sheet detection apparatus of FIG. 1.

FIG. 1 is a top plan view showing a paper sheet detection apparatus according to a first embodiment of the present invention. FIG. 2 is a front view of the paper sheet detection apparatus. FIG. 3 is a side view of the paper sheet detection apparatus.

The detection apparatus has conveying belts 1, 2 as a conveying device, which holds both sides of a paper sheet P and conveys the paper sheet in the arrow C direction. The conveying belts 1 and 2 are laid over rollers 4*a*, 4*b*, and run. The conveying belts 1, 2 are formed with upper and lower belt parts 1*a*, 1*b* and 2*a*, 2*b* disposed opposite to each other, and hold and convey a paper sheet P by these upper and lower belt parts 1*a*, 1*b* and 2*a*, 2*b*.

A sensor guide 3 is provided as a guide device between the conveying belts 1 and 2. The sensor guide 3 is formed with upper and lower guide members 5, 6 disposed opposite to each other with a predetermined interval through the conveying surface of a paper sheet P. The upper and lower guide members 5, 6 are fixedly held by a base 11 through holders 8, 9.

In the paper sheet take-out side of the sensor guide 3, a detection sensor 12 is provided as a detection device. The detection sensor 12 is fixedly supported by a holder 9 of the lower guide member 6, for example.

Air tubes 14 and 15 are connected to the upper and lower guide members 5 and 6, respectively, to supply compressed fluid, for example, compressed air. The upper guide member 5 is supported by the upper holder 8 through a universal joint 17 and a shaft 18. The shaft 18 is movable in the length direction, but the rotation is restricted.

A coil spring 20 is inserted between the holder 8 and the universal joint 17, and the shaft 18 is inserted into the coil spring 20. The upper guide member 5 is pressed to the lower guide member 6 by the emerging force of the coil spring 20, to be parallel along the upper surface of the lower guide member 6 by the action of the universal joint 17.

Figure 4A:
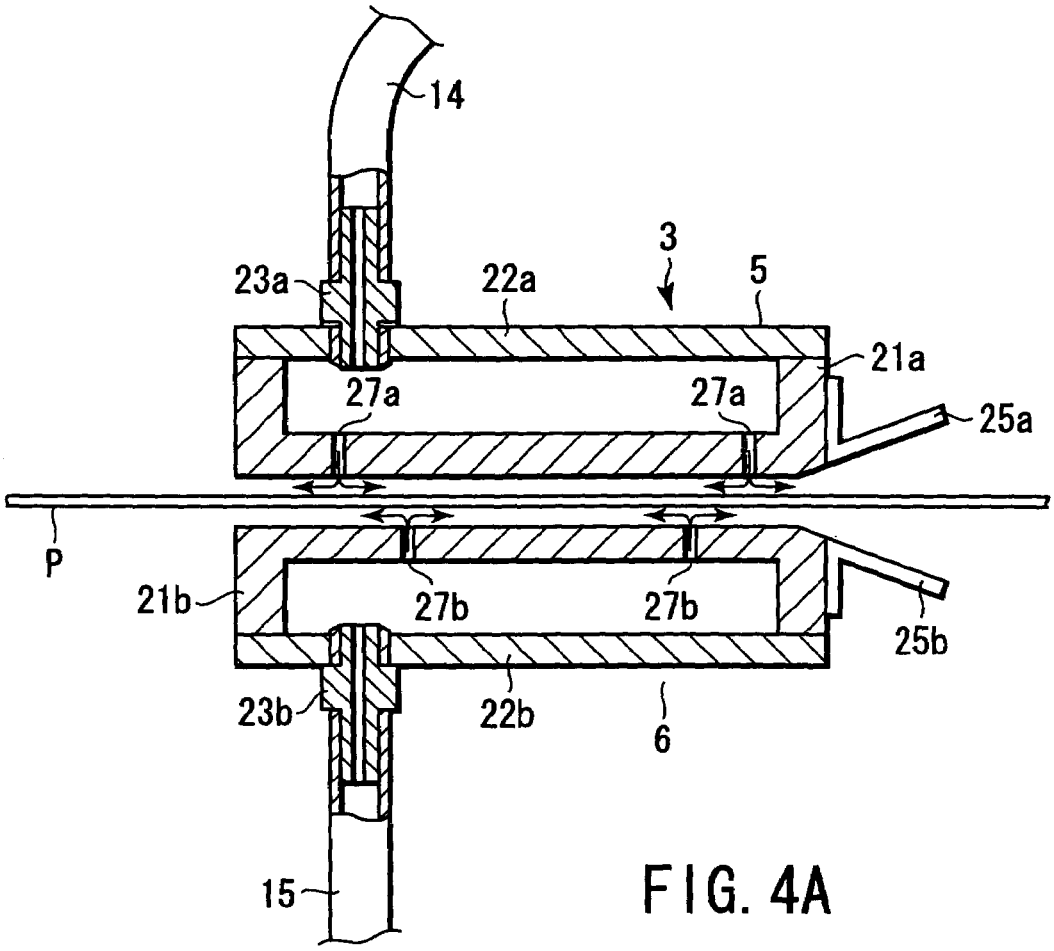
FIG. 4A is a sectional view showing the paper sheet detection apparatus of FIG. 1 taken along the line D—D.

FIG. 4A is a sectional view showing the sensor guide 3 taken along the arrow line D—D in FIG. 1.

The upper and lower guide members 5 and 6 have nozzle boxes 21*a* and 21*b*, respectively. The nozzle boxes 21*a* and 21*b* are closed by lids 22*a* and 22*b*, respectively, through a packing material not shown in the drawing. The air tubes 14 and 15 are connected to the lids 22*a* and 22*b* through tube fittings 23*a* and 23*b*. Guide plates 25*a* and 25*b* are fixed to the end faces of the paper sheet take-in sides of the nozzle boxes 21*a* and 21*b*.

In the opposite surfaces of the nozzle boxes 21*a* and 21*b*, nozzles 27*a* and 27*b* are formed to eject compressed air.

Figure 4B:
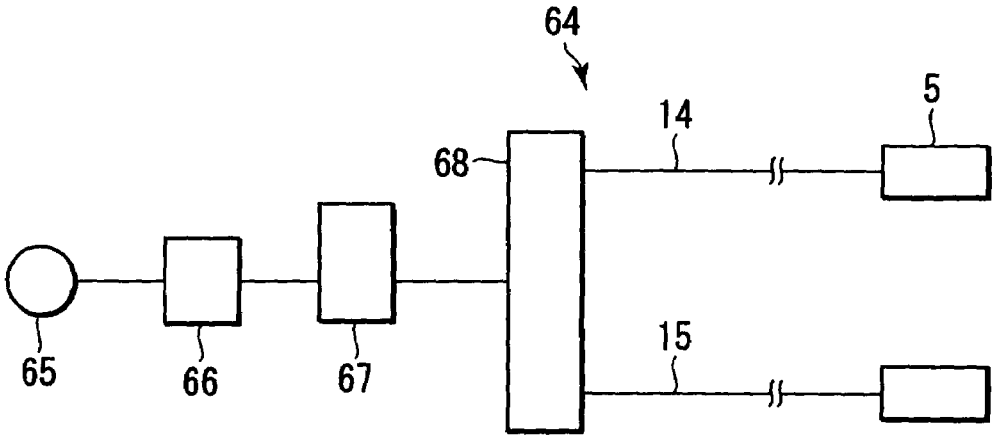
FIG. 4B is a block diagram showing a supply mechanism which supplies compressed air to a sensor guide of the paper sheet detection apparatus of FIG. 1.

FIG. 4B is a block diagram showing a gas supply device 64, which supplies the upper and lower guide members 5 and 6 with compressed air as compressed gas.

In the drawing, a reference numeral 65 denotes a compressed air source. The compressed air source 65 is connected with a manifold 68 through a pressure reducing device 66 and a solenoid valve 67 that is opened and closed by an electric signal. The manifold 68 is connected with the upper and lower guide members 5 and 6 through the air tubes 14 and 15.

Next, explanation will be given to the detection operation of the paper sheet detection apparatus configured as described above.

First, a paper sheet P is held and conveyed by conveying belts 1 and 2, and at the same time the compressed air source 65 is operated. By the operation of the compressed air source 65, compressed air is fed out, reduced the pressure in the pressure reducing device 66, and supplied to the upper and lower guide members 5 and 6, respectively, through the manifold 68 and the air tubes 14 and 15. The supplied compressed air is ejected from the nozzles 27*a* and 27*b*, respectively.

By the compressed air ejected from the nozzles 27*a* and 27*b*, an air layer, which is determined by the pressure and flow rate of the compressed air, the atmospheric pressure, and the pressing force of the coil spring 20, is formed between the opposite surfaces of the upper and lower guide members 5 and 6, and the guide members 5 and 6 are balanced by repulsing each other.

In this state, a paper sheet P is fed between the upper and lower guide members 5, 6, and an air layer is formed between the upper and lower guide members 5, 6 and both sides of the paper sheet P, respectively. Thus, the paper sheet P is floated from the upper and lower guide members 5, 6, and guided and conveyed to the detection sensor 12 in the non-contacted state with the both sides pressed and held by the air layers, and the information of the paper sheet is detected.

In this time, the upper guide member 5 is pressed by the coil spring 20, and the paper sheet P is kept flat without being flapped and bent.

As above described, the paper sheet P is floated from the upper and lower guide members 5, 6, and guided and conveyed in the non-contacted state with the both sides pressed and held by the air layers, and the paper sheet P is kept flat without being flapped and bent caused by the vibration of the conveying belts 1, 2.

Therefore, the detection sensor 12 can detect a signal in the state with no flapping and bending of the paper sheet P, increasing the detection accuracy.

Figure 5:
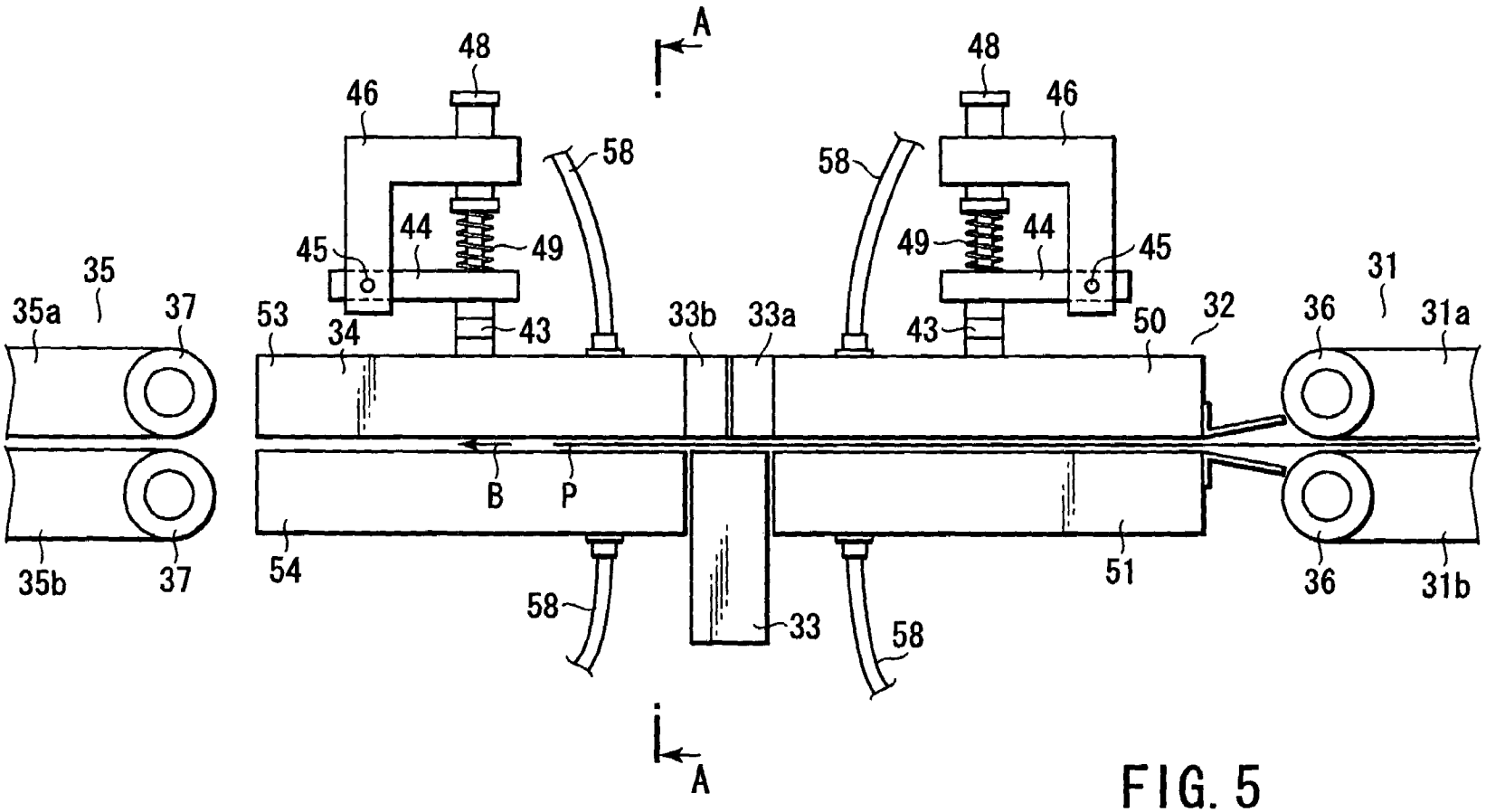
FIG. 5 is a front view showing a paper sheet detection apparatus according to a second embodiment of the present invention.
Figure 6:
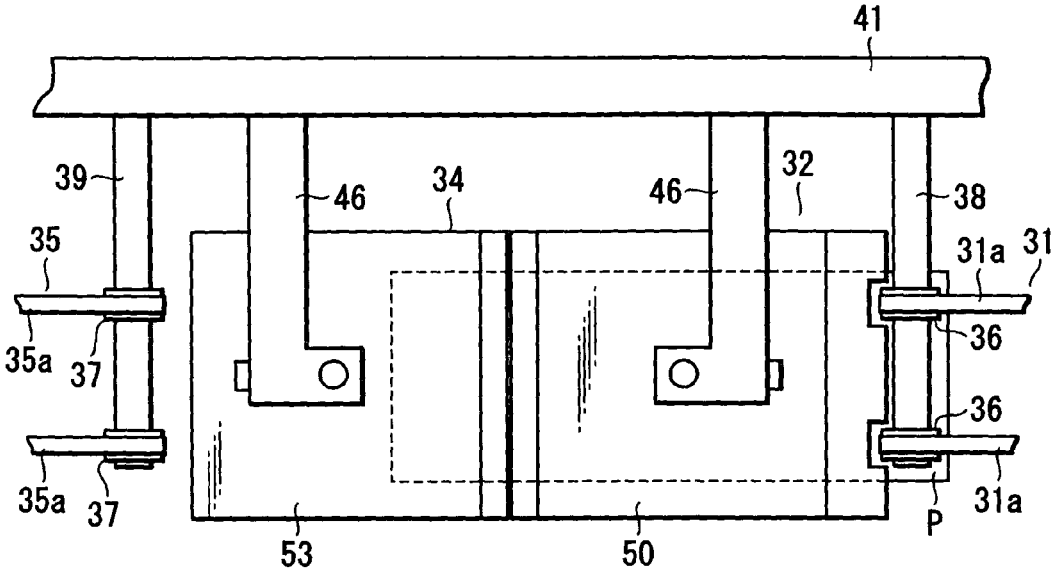
FIG. 6 is a top plan view of the paper sheet detection apparatus of FIG. 5.
Figure 7:
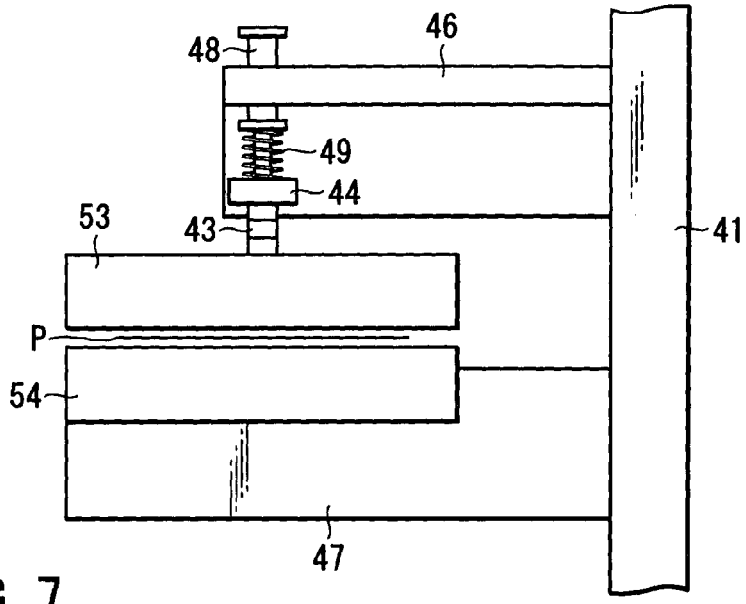
FIG. 7 is a view taken along the line A—A in FIG. 5.

FIG. 5 shows a paper sheet detection apparatus according to a second embodiment of the present invention. FIG. 6 is a front view of the apparatus, and FIG. 7 is a side view of the apparatus.

In these drawings, a reference numeral 31 denotes a first conveying device, which holds and conveys a paper sheet P. In the downstream side of the paper sheet conveying direction of the first conveying device 31, a first sensor guide 32 as a guide device, a detection sensor 33 as a detection device, a second sensor guide 34 as a guide device, and a second conveying device 35 are sequentially disposed along the paper sheet P conveying direction.

The first and second conveying devices 31, 35 are composed of upper conveying belts 31*a*, 31*a*, 35*a*, 35*a* disposed in parallel along the paper P with a predetermined interval, and lower conveying belts 31*b*, 31*b*, 35*b*, 35*b* provided under the upper conveying belts 31*a*, 31*a*, 35*a*, 35*a*, so as to hold and convey the paper sheet P in the arrow B direction.

The upper conveying belts 31*a*, 31*a*, 35*a*, 35*a* and lower conveying belts 31*b*, 31*b*, 35*b*, 35*b* are laid over rollers 36, 36, 37, 37. The rollers 36, 36, 37, 37 are supported by a base 41 through support shafts 38, 39.

The first and second sensor guides 32, 34 are formed with upper and lower guide members 50, 51 and 53, 54, disposed opposite to each other through a conveying surface H to convey a paper sheet P, and placed before and after the detection sensor 33.

The upper guide member 50 of the first sensor guide 32 is supported by a holder 46 through a universal joint 43, a support bar 44 and a support pin 45, and rotatable around the support pin 45. The holder 46 is fixed to the base 41. The support bar 44 is pressed by a push screw 48 and a spring member 49, pressing the upper guide member 50 to the lower guide member 51. The lower guide member 51 is fixedly provided on the base 41 through a holder 47.

The second sensor guide 34 is configured in the say way as the first sensor guide 32. The same reference numerals are given to the same parts, and the description will be omitted.

Figure 8:
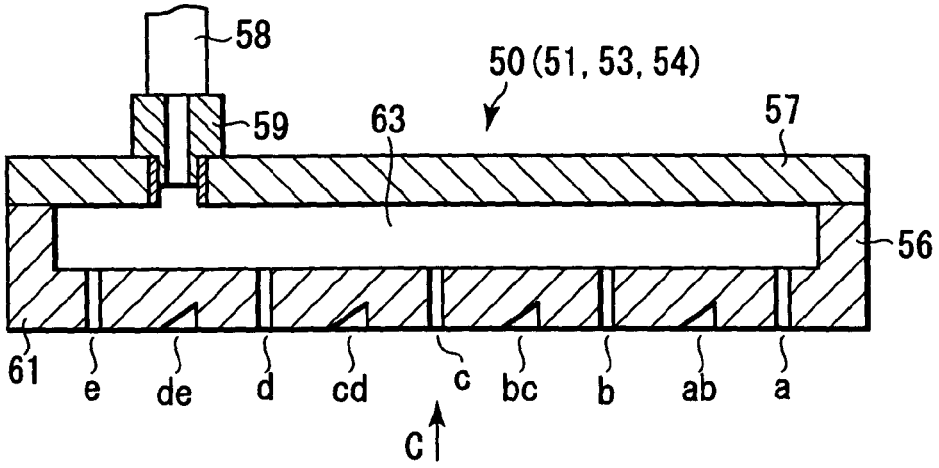
FIG. 8 is a sectional view showing an upper guide member of a sensor guide provided in the paper sheet detection apparatus of FIG. 5.

FIG. 8 is a sectional view showing the upper and lower guide members 50, 51 and 53, 54, which constitute the first and second sensor guides 32, 34.

The upper and lower guide members 50, 51 and 53, 54 are configured in the same way, and only the upper guide member 50 will be explained as a representative. The upper guide member 50 has a nozzle box 56. The nozzle box 56 is closed by a lid 57 that is fixed through a not-shown packing member. The lid 57 is connected with an air tube 58 through a tube fitting 59. The nozzle box 56 is formed with many nozzles for ejecting compressed air, as described later.

Figure 9:
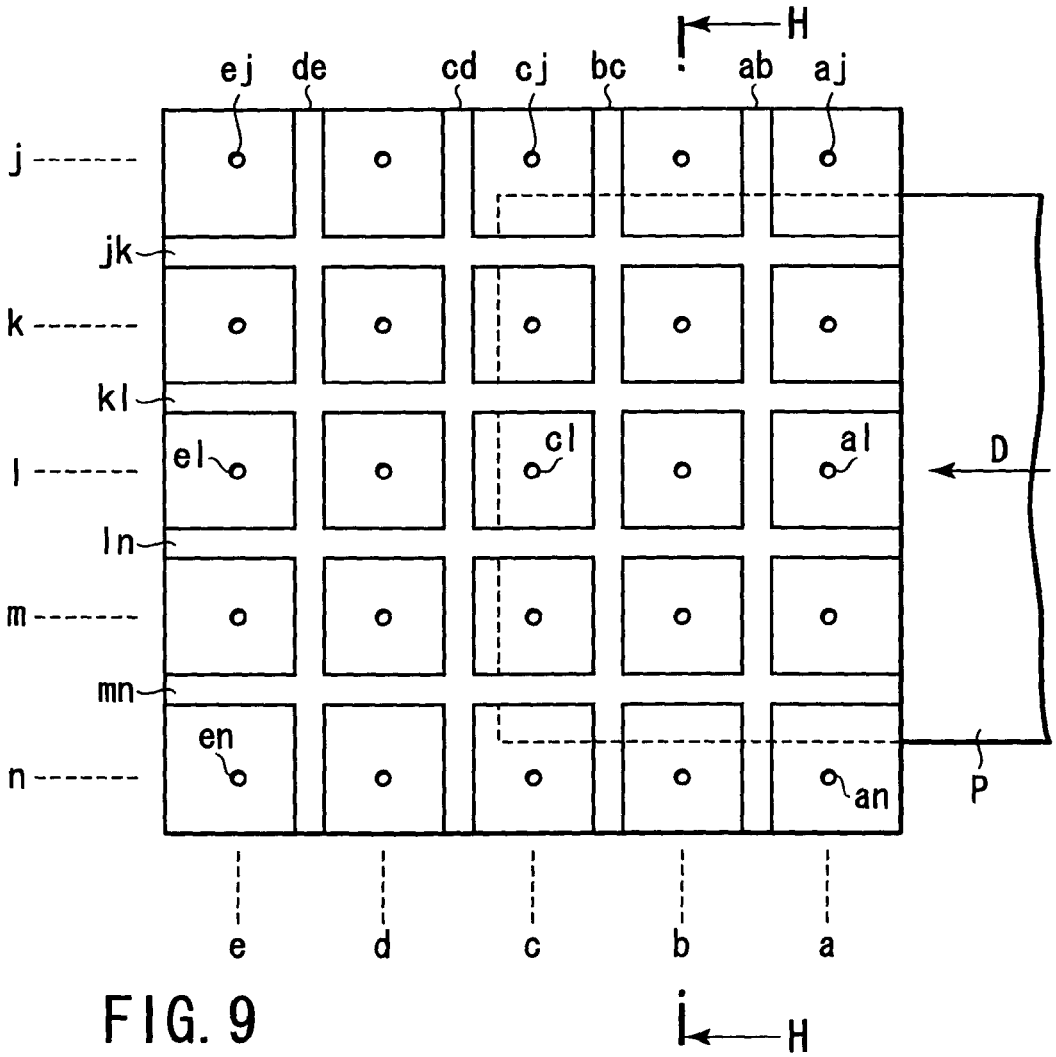
FIG. 9 is a bottom view showing the upper guide member of FIG. 8.

Namely, in the opposite surface 61 of the upper and lower guide members 50, 51 and 53, 54, nozzles aj, . . . en are provided as a matrix of a, b, c, d, e rows and j, k, i, m, n columns, as shown in FIG. 9, and grooves ab, bc, cd, de, jk, kl, lm, mn are provided surrounding the nozzles aj, . . . en.

The distance between the nozzles of the j and n columns disposed in the outermost side is set larger than the width dimension of a paper sheet P.

The grooves jk, kl, lm, mn are formed in parallel along the paper sheet P conveying direction, and the grooves ab, bc, cd, de are formed in parallel along the direction orthogonal to the paper sheet P conveying direction.

Compressed air is supplied to the nozzles aj, . . . en from a cavity 63 between the nozzle box 56 and the lid 57. The grooves ab, dc, cd, de are shaped like a saw tooth, so that the corners of the grooves ab, dc, cd, de do not disturb the conveyance of the paper sheet P in the arrow D direction.

The nozzles aj, . . . en and the grooves ab, bc, cd, de formed on the opposite surface 61 of the upper and lower guide members 50, 51, 53, 54 are provided at the opposite positions, but the nozzles aj, . . . en may be provided at the position shifted from the opposite positions.

Figure 10:
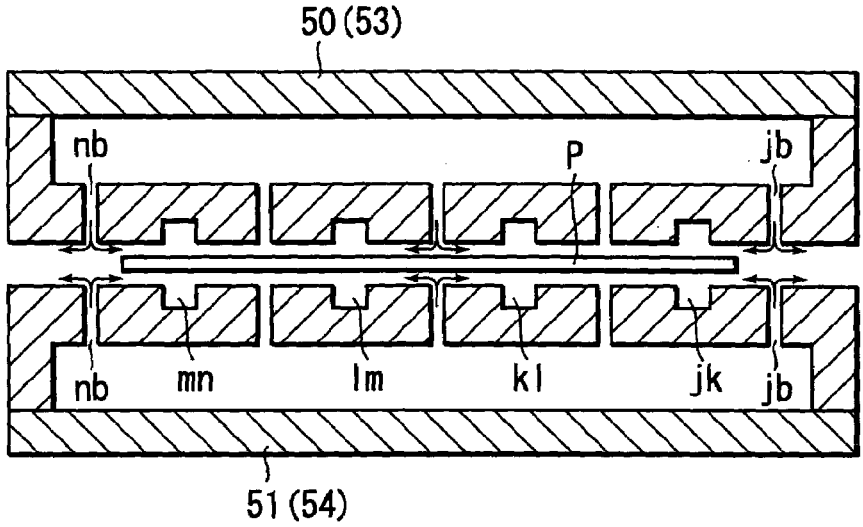
FIG. 10 is a sectional view showing a sensor guide provided in the paper sheet detection apparatus of FIG. 5.

FIG. 10 is a sectional view taken along the E—E line in FIG. 9, showing the positional relationship between the guide members 50 (53), 51 (54) and the paper sheet P, and the flow state of compressed air by an arrow.

Figure 11:
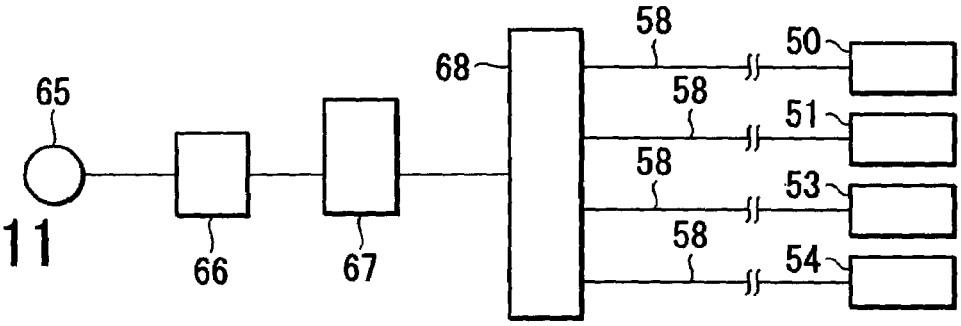
FIG. 11 is a block diagram showing a supply mechanism which supplies compressed air to the sensor guide of FIG. 10.

FIG. 11 is a block diagram showing a gas supply device for supplying compressed air to the upper and lower guide members 50, 51 and 53, 54, which constitute the first and second sensor guides 32, 34. The gas supply device is configured in the same way as the gas supply device 64 shown in FIG. 4B, and the same reference numerals are give to the same parts.

In the drawing, a reference numeral 65 denotes a compressed air source. The compressed air source 65 is connected with a manifold 68 through a pressure reducing device 66 and a solenoid valve 67 that is opened and closed by an electric signal. The manifold 68 is connected with the upper and lower guide members 50, 51 and 53, 54 through the air tube 58.

Next, the detecting operation of the paper sheet detection apparatus configured as above described will be explained.

First, when a paper sheet P is held and conveyed by running the conveying belt 31, the compressed air source 65 is operated. By the operation of the compressed air source 65, compressed air is supplied. The compressed air is reduced in the pressure reducing device 66, and supplied to the upper and lower guide members 50, 51 and 53, 54 through the solenoid valve 67, the manifold 68 and the air tube 58, as shown in FIG. 10.

The compressed air is ejected from each nozzles aj, . . . en in the opposite surfaces 61, 61 of the upper and lower guide members 50, 51 and 53, 54. By this ejection, the upper and lower guide members 50, 51 and 53, 54 repulse each other, and the ejected compressed air is exhausted to the outside of the guide members 50, 51, 53, 54 from the grooves ab, bc, cd, de around the nozzles aj, . . . en.

Then, the upper guide members 50, 53 are supported and raised in the direction of separating from the lower guide members 51, 54, by the universal joint 43, the support bar 44 and the support pin 45, but stopped at the position where the air layers are balanced by the pressing force of the spring 49 and the compressed air ejecting force.

In this state, a paper sheet P is inserted between the upper and lower guide members 50 and 51, and a compressed air layer is formed between the upper and lower guide members 50, 51 and both sides of the paper sheet P. Thus, the paper sheet P is guided and conveyed to the detection sensor 33 in the floated state with both sides pressed and held by the air layers, and the information of the paper is detected.

After the information is detected, the paper sheet P is inserted between the upper and lower guide members 53 and 54 located in the downstream side, and further guided and conveyed in the floated state, as described above.

The clearance between the upper and lower guide members 50, 51 and 53, 54 and the flat part around the nozzles, and the clearance between the both sides of the paper sheet P and the flat part around the nozzles of upper and lower guide members 50, 51 and 53, 54, are 0.030 to 0.050 mm, when the compressed air pressure is set to 0.1 Mpa, the pressing force of the spring 49 is set to 0.1 N, and the nozzle diameter is set to 1 mm.

Therefore, the paper sheet P is conveyed within a space of 0.030 to 0.050 mm, and the flap and bending of the paper are negligible, and a stable detection signal is obtained in the detection sensor 33.

Further, in this embodiment, as shown in FIG. 10, in the opposite parts of the nozzles viewed from the paper sheet conveying direction in FIG. 9, the opposite surfaces of the nozzles arranged in the j-row and n-column outside of both ends of the paper sheet P has a clearance that is larger by the thickness of the paper sheet P, and the air layer flow rate becomes slower than the rate in the part where the paper sheet P exists, and the pressure rises and functions as a force to push the paper sheet P inward.

Therefore, the paper sheet P can be advanced straight between the upper and lower guide members 50, 51 and 53, 54 by inertia without meandering, even if it is not pressed by the conveying belts 31 and 35.

For more ensured conveyance of the paper sheet P within the sensor guides 32 and 34, it is recommended to set the clearance between the guide rollers 36 and 37 of the belts 31 and 35 smaller than the length of the paper conveying direction. The paper sheet P is to be held by one of the conveying belts 31 and 35, and the conveying force will not be weakened.

A reference numeral 33*a* in FIG. 5 denotes a dummy or a sensor fixed to the upper guide member 50 to be used as a guide of the surface opposite to the detection sensor 33. A reference numeral 33*b* denotes a dummy or a sensor fixed to an upper guide member 53.

Figure 12:
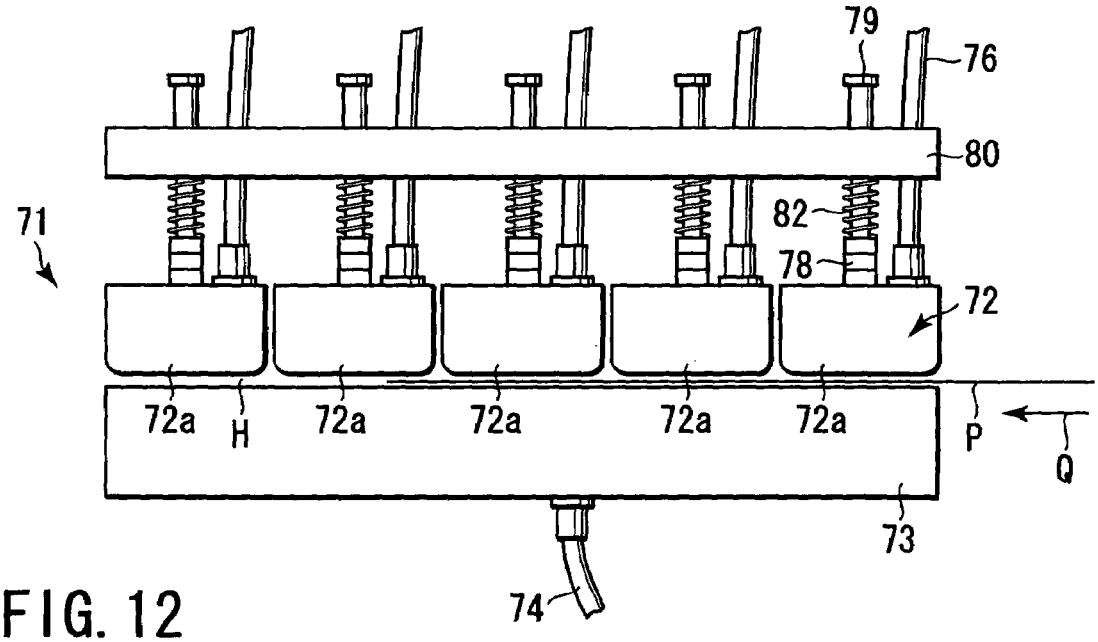
FIG. 12 is a front view showing a sensor guide of a paper sheet detection apparatus according to a third embodiment of the present invention.
Figure 13:
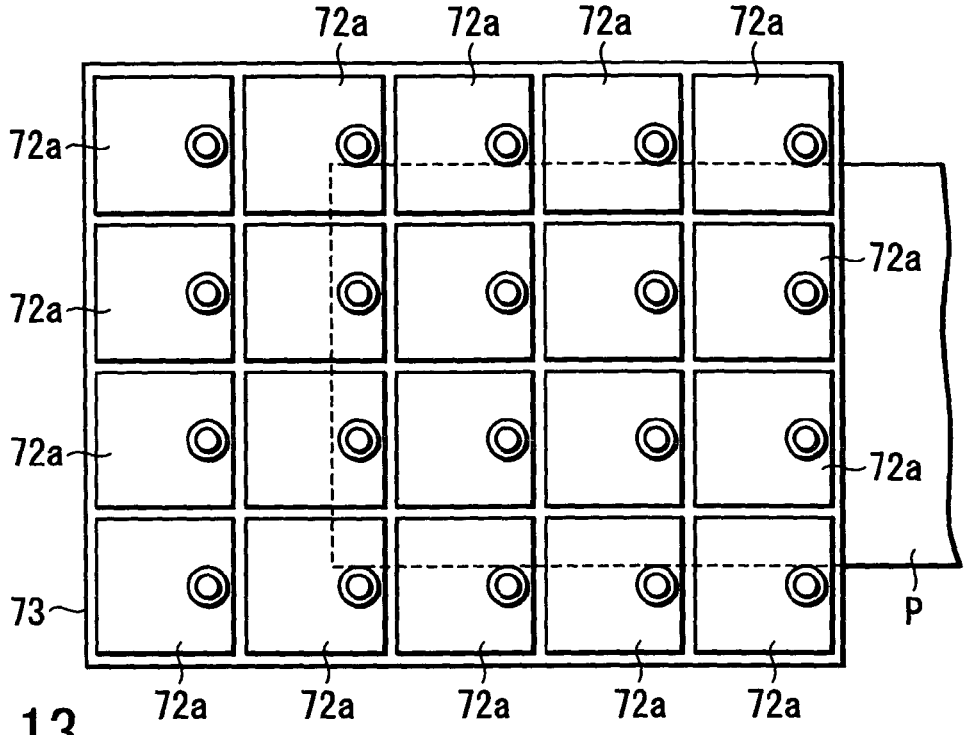
FIG. 13 is a top plan view of the sensor guide of FIG. 12.

FIG. 12 shows a sensor guide 71 according to a third embodiment of the present invention.

The sensor guide 71 is formed with upper and lower guide members 72 and 73 that are disposed opposite to each at both sides of a conveying surface H to convey a paper sheet P. A paper sheet P is guided by the upper and lower guide members 72, 73, and conveyed in the arrow Q direction.

The lower guide member 73 is fixedly provided, has a plurality of nozzle holes (not shown) on the upper surface, and is connected to an air tube 74 in the lower surface.

The upper guide member 72 consists of a plurality of divided guide parts 72*a*. The divided guide parts 72*a* are arranged vertically and horizontally in the paper sheet P conveying direction and the direction orthogonal to the paper sheet P conveying direction.

Each divided guide part 72*a* is connected with an air tube 76 to supply compressed air. The divided guide part 72*a* is connected with a shaft 79 through a universal joint 78. The shaft 79 is held movable vertically by a holder 80, but the movement in the rotating direction is restricted.

A coil spring 82 is inserted in the compressed state between the holder 80 and the universal joint 78. The shaft 79 is inserted into the coil spring 82.

The coil spring 82 presses by its restoring force the divided guide part 72*a* to the lower guide member 73. The divided guide part 72*a* has a nozzle hole (not shown) in the lower surface to eject compressed air. The nozzle hole provided in the conveying surface H of the lower guide member 73 is opposite to each divided guide part 72*a*.

According to this embodiment, the upper guide member 72 consists of a plurality of divided guide parts 72*a* arranged vertically and horizontally, and a paper sheet P can be guided within a narrower range meeting the changes in the thickness distribution of a paper sheet P, for example. This provides an advantage that flapping and bending of the paper sheet P can be suppressed more securely.

Figure 14:
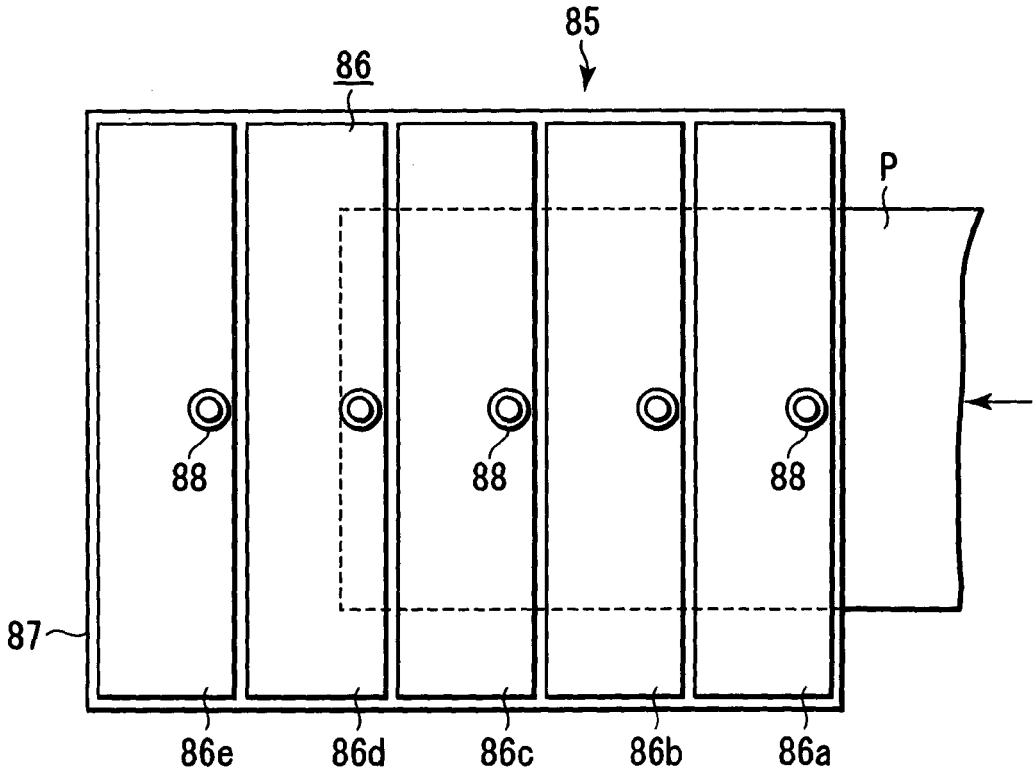
FIG. 14 a front view showing a sensor guide of a paper sheet detection apparatus according to a fourth embodiment of the present invention.

FIG. 14 shows a sensor guide 85 according to a fourth embodiment of the present invention.

The sensor guide 85 is formed with upper and lower guide members 86 and 87 that are disposed opposite to each other.

The upper guide member 86 is divided in parallel into a plurality of divided guide parts 86*a*–86*e* only in the direction orthogonal to the paper sheet P conveying direction. These divided guide parts 86*a*–86*e* are supported and movable in the same configuration as that shown in FIG. 12, and an air tube 88 is connected to the upper surface.

The lower guide member 87 is configured and fixedly held in the same way as that shown in FIG. 12.

Figure 15:
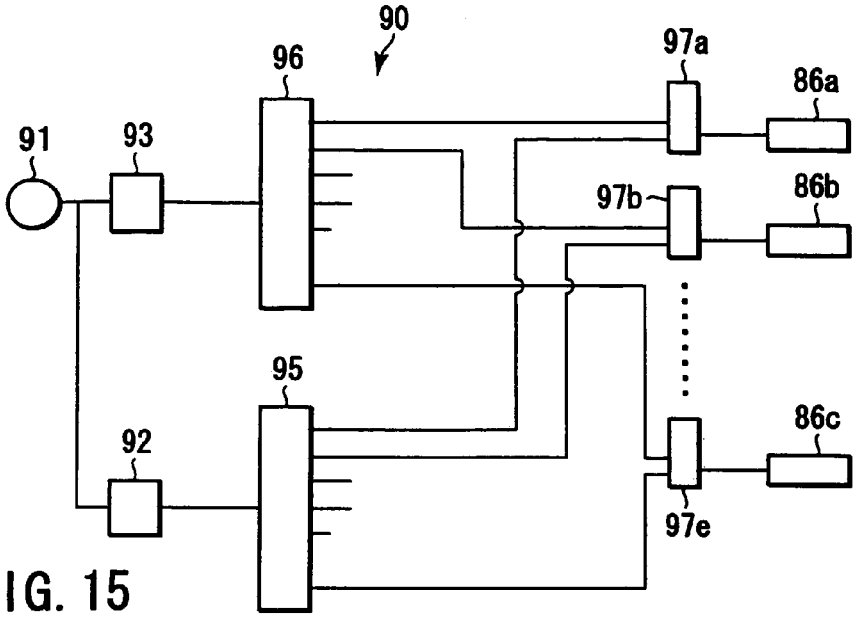
FIG. 15 is a block diagram showing a supply mechanism which supplies compressed air to the sensor guide of FIG. 14.

FIG. 15 is a block diagram showing a gas supply device 90 for supplying compressed air to the divided guide parts 86*a*–86*e* of the above-mentioned upper guide member 86.

In the drawing, a reference numeral 91 denotes a compressed air source. The compressed air source 91 is connected with first and second manifolds 95, 96 through first and second pressure reducing devices 92, 93. The first and second manifolds 95, 96 are connected with the divided guide parts 86*a*–86*e* through the air tube 88 and solenoid valves 97*a*–97*e*.

The first pressure reducing device 92 is set to 0.1 Mpa, and the second pressure reducing device 93 is set to 0.15 Mpa, for example, to be able to supply high and low pressures to the divided guide parts 86*a*–86*e* by switching the solenoid valves 97*a*–97*e* by an electric signal.

According to this embodiment, it is possible to convey a paper sheet P very well on a pressure wave just like a running pressure wave, by switching the pressure of the compressed air supplied to the divided guide parts 86*a*–87*e* to high and low at a predetermined cycle in the paper sheet P conveying direction, by switching the solenoid valves 97*a*–97*e*.

It is also possible to obtain the conveying force by increasing and decreasing the flow rate of the compressed air, not by controlling the compressed air pressure value.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet detection apparatus comprising:

a conveying device which conveys a paper sheet along a conveying surface;

a detection device which is provided opposite to the conveying surface and detects the paper sheet conveyed by the conveying device;

a guide device which is provided in at least a paper sheet take-in side of the detection device and includes a pair of guide members disposed opposite to each other at both sides of the conveying surface, wherein one of the pair of guide members is fixed and the other guide member is movable relative to the one guide member;

at least one nozzle which is provided in each of the guide members;

an energizing device which elastically energizes the other guide member toward the one guide member; and a gas supply device which generates a clearance between the pair of guide members by moving the other guide member against the energizing force of the energizing device, by supplying compressed gas to the pair of guide members and ejecting the gas from the nozzles between the pair of guide members.

2. The paper sheet detection apparatus according to claim 1, wherein the guide device is provided in the paper sheet take-in side and a take-out side of the detection device.

3. The paper sheet detection apparatus according to claim 1, further comprising a plurality of grooves provided at a certain interval on said pair of guide members in a paper sheet conveying direction and in a direction orthogonal to the conveying direction, an said at least one nozzle includes a plurality of nozzles provided at least in parts surrounded by said plurality of grooves on said pair of guide members.

4. The paper sheet detection apparatus according to claim 3, wherein said plurality of nozzles are disposed in columns that are parallel to the paper sheet conveying direction, and an interval between the two outermost nozzle columns is set wider than a width dimension of the paper sheet in the direction orthogonal to the conveying direction.

5. The paper sheet detection apparatus according to claim 1, wherein the other guide member consists of a plurality of divided guides divided vertically and horizontally along the paper sheet conveying direction and the direction orthogonal to the conveying direction; and each of the divided guides is movable, and has one of said at least one nozzle to eject compressed gas.

* * * * *